United States Patent [19]

Masuda et al.

[11] 4,456,477

[45] Jun. 26, 1984

[54] PRODUCTION OF ULTRA-LOW PHOSPHORUS STEEL

[75] Inventors: Seiichi Masuda; Tohru Matsuo; Yoshimichi Ohkita, all of Nishinomiya; Takeo Aoki, Kawanishi; Hidemasa Nakajima, Iharaki; Shozo Okamura, Ibaraki; Takeyuki Hirata, Ibaraki; Shoji Anezaki, Ibaraki, all of Japan

[73] Assignee: Sumitomo Metal Industries, Inc., Osaka, Japan

[21] Appl. No.: 498,863

[22] Filed: May 27, 1983

[30] Foreign Application Priority Data

May 28, 1982 [JP] Japan ..... 57-91717

[51] Int. Cl.[3] ..... C21C 5/32; C21C 5/34

[52] U.S. Cl. ..... 75/51; 75/52; 75/59; 75/60

[58] Field of Search ..... 75/51, 52, 59, 60

[56] References Cited

U.S. PATENT DOCUMENTS 4,358,314 11/1982 Normanton ..... 75/51

*Primary Examiner*—Peter D. Rosenberg

*Attorney, Agent, or Firm*—Burns, Doane, Swecker & Mathis

[57] ABSTRACT

A process for producing an ultra-low phosphorus steel containing 0.010% or less of phosphorus is disclosed, which comprises charging a desiliconized pig iron into a top- and bottom-blowing oxygen converter, introducing a slag-forming agent in a powdered form onto the molten iron together with the top-blowing oxygen and introducing a bottom-blowing gas selected from the group consisting of an inert gas, nitrogen gas, oxygen gas, carbon monoxide gas, carbon dioxide gas and mixtures thereof during the oxygen top-blowing or during both the oxygen top-blowing and the subsequent tapping.

10 Claims, 3 Drawing Figures

PRODUCTION OF ULTRA-LOW PHOSPHORUS STEEL

BACKGROUND OF THE INVENTION

This invention relates to a process for producing an ultra-low phosphorus steel, which comprises applying oxygen top-blowing to a pig iron which has previously been desiliconized. More specifically, this invention relates to a process for producing an ultra-low phosphorus steel containing 0.010% or less of phosphorus by means of a top- and bottom-blowing steel refining process (hereunder "TB process").

It has long been desired in the art to reduce the phosphorus content of steel in an economical manner so as to further improve workability as well as mechanical properties of steel.

In the oxygen top-blowing steel making process, which is generally used in Japan, molten iron, scrap and other starting materials are charged into a converter and the refining of steel is carried out while blowing pure oxygen onto the charge melt through an oxygen lance. Usually, the phosphorus content of oxygen-refined steels is in the range of 0.015 to 0.035%.

An additional step is applied to such a steel making process as in the above so as to further lower the phosphorus content. Now considering the process for reducing the phosphorus content in steel, it is noted that there are the following three main practical methods in the art: (i) a double-slag process; (ii) pig iron dephosphorization; and (iii) dephosphorization after steel refining.

(i) The double-slag process is a two-stage refining process in which the first-stage refining is applied to molten steel in a relatively high carbon range, then refining is interrupted, and after separating the refined steel in a high carbon range from slag by tapping the molten steel or by removing the fluidized slag after the addition of fluorspar from the converter. The second stage refining is applied to the thus separated molten steel by adding another quicklime to the molten steel.

(ii) The pig iron dephosphorization, i.e., hot metal dephosphorization is a process in which a slag-forming flux containing quicklime, fluorspar and iron ore is introduced onto a pig iron bath in the ladle, while maintaining it at a sufficiently high temperature to effect dephosphorization by blowing an exothermic gas, such as oxygen into the bath. Alternatively, the dephosphorization can be carried out by adding a flux containing calcined soda or quicklime, fluorspar and iron ore to a molten pig iron which has been desiliconized to a level of 0.15% of Si. After dephosphorization, the thus desiliconized and dephosphorized pig iron is charged into a converter and a sufficient amount of quicklime is added to the bath so as to suppress the re-phosphorization in the converter. The addition of another large amount of quicklime is also effective in furthering the dephosphorization during steel refining.

(iii) The dephosphorization after steel refining is carried out by adding a flux containing quicklime, fluorspar and iron ore to the molten steel in the ladle or to the molten steel during tapping.

In such processes of steel refining, desiliconization has widely been applied as one of the means of pretreatment of pig iron in order to reduce the requisite amount of quicklime, which is necessary as one of the auxiliary materials. The desiliconization is also effective in reducing the amount of slag which is formed during the refining process. It is, in fact, possible to reduce the requisite amount of quicklime by 16–17 kg per ton of pig iron when the proportion of silicon in pig iron is reduced to 0.13–0.16% by applying desiliconization to the pig iron prior to the refining. This is because some of the quicklime added is usually consumed to neutralize the $SiO_2$ which is derived from the silicon dissolved in the pig iron during the oxygen refining process. Therefore, the amount of quicklime to be added is usually determined by considering the silicon concentration of the pig iron.

However, it is to be noted that the presence of silicon in pig iron is essentially necessary for steel refining, because the silicon in pig iron generates heat when it is oxidized during refining. The thus generated heat is effective in preparing slag, namely in melting the quicklime which is added to the bath as a slag-forming agent. Therefore, the reduction in silicon content in pig iron would result in less formation of slag.

On the other hand, the presence of quicklime in slag is necessary to dephosphorize a molten pig iron, since the molten quicklime in slag is combined with phosphorus in pig iron to achieve dephosphorization. Therefore, the presence of a substantial amount of quicklime in slag is essential for dephosphorization of pig iron during refining.

Therefore, though it is possible to apply desiliconization to a pig iron, it is not desirable to reduce the amount of quicklime to be added to the pig iron from the viewpoint of preparing an active slag for dephosphorization.

Thus, it has been thought in the art that it is impossible to apply desiliconization so as to produce low phosphorus steel and that any reduction in the phosphorus content requires a complicated and expensive process as long as the conventional dephosphorizing processes are concerned. In addition, such conventional dephosphorizing processes are always followed by a substantial reduction in tapping or total yield.

In this respect, U.S. Pat. No. 4,290,802 discloses the addition of a slag-forming agent such as quicklime to a molten steel in the TB process. However, it does not suggest anything about the employment of desiliconization as one of the means of pre-treating pig iron. Furthermore, the phosphorus content of steel which is produced in accordance with the process disclosed in this patent is 0.012% at the lowest.

It is herein to be noted that the degree of difficulty encountered in effecting dephosphorization depends on the starting phosphorus concentration. For example, it is not so difficult to reduce phosphorus from a level of 0.5% to a level of 0.05%. However, it is quite difficult to reduce the phosphorus content to 0.02% or less without reduction in tapping yield or without resulting in a prolonged period of treating time.

It has been thought that as long as the conventional process is concerned, it is impossible to achieve a $CaO/SiO_2$ ratio of slag higher than 4. This is partly because the presence of much of the silicon is unavoidable, and partly because an amount of quicklime to make the ratio higher than 4 cannot be dissolved into the slag.

OBJECTS OF THE INVENTION

The primary object of this invention is to provide a process for producing an ultra-low phosphorus steel the phosphorus content of which is 0.010% or less.

A secondary object of this invention is to provide a process for producing such an ultra-low phosphorus steel in a less expensive and industrially feasible manner.

Another object of this invention is to produce a process for producing an ultra-low phosphorus steel the phosphorus content of which is 0.003% or less without resulting in any substantial reduction in tapping or total yield nor prolonged treating period of time.

SUMMARY OF THE INVENTION

According to the findings of the inventors of this invention, the combination of desiliconization of pig iron and the addition of powdered quicklime in top- and bottom-blowing steel making process unexpectedly results in an efficient and less expensive process for reducing the phosphorus content to an ultra-low level, such as 0.010% or less, preferably 0.003% or less without resulting in any substantial loss of yield.

Thus, this invention resides in a process for producing an ultra-low phosphorus steel, which comprises charging a desiliconized pig iron into a top- and bottom-blowing oxygen converter, introducing a slag-forming agent in a powdered form onto the molten iron together with the top-blowing oxygen, and introducing a bottom-blowing gas selected from the group consisting of an inert gas, nitrogen gas, oxygen gas, carbon monoxide gas, carbon dioxide gas and mixtures thereof during the top-blowing of pure oxygen or during both the top-blowing of pure oxygen and the subsequent tapping.

The desiliconized pig iron may preferably be subjected to pre-dephosphorization before it is charged into the top- and bottom-blowing converter. It is advisable that the starting pig iron be desiliconized to a level of 0.20% or less, usually 0.01–0.17% of Si. When the pre-phosphorization is applied to the pig iron prior to the oxygen refining, it is also advisable to reduce the phosphorus content to 0.030% or less and that of silicon to 0.05% or less. This can be achieved by blowing oxygen into the pig iron in the presence of quicklime. It is herein to be noted that the desiliconization of pig iron according to this invention may be performed in any suitable manner already known to the artisan. The slag-forming agent employed in this invention is in the form of powder and is ejected onto the surface of the molten metal together with an oxygen jet. The bottom-blowing is employed so as to vigorously agitate the molten metal being treated. This will enhance the formation of an active slag for dephosphorization.

In a preferred embodiment of this invention, the ratio $CaO/SiO_2$ of slag may be restricted to higher than 4.5, preferably higher than 5.0 so as to reduce the phosphorus content to an ultra-low level. It is herein to be noted that a $CaO/SiO_2$ ratio higher than 10.0 is attainable in accordance with this invention.

The slag-forming agent in a powdered form is comprised of one or more selected from the group consisting of quicklime, limestone, fluorspar, dolomite, iron ore and mixtures thereof.

The structure of the converter and that of the oxygen lance to be employed in this invention may be the same as disclosed in the above mentioned U.S. Pat. No. 4,290,802, the disclosure of which is incorporated herein for reference.

DETAILED DESCRIPTION OF PREFERRED EMBODIMENTS OF THIS INVENTION

Figure 1:
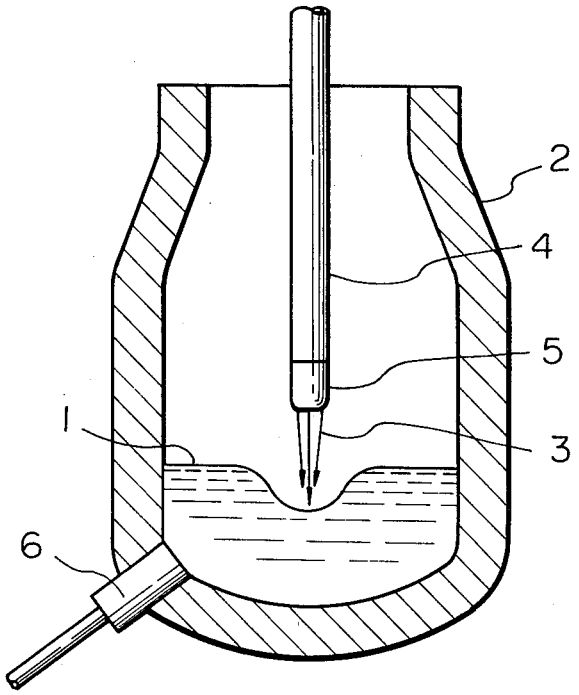
FIG. 1 is a diagrammatical view of a steel making converter to be employed for the purpose of this invention.

As shown in FIG. 1, a desiliconized pig iron 1 is charged into a top- and bottom-blowing converter 2, in which an oxygen jet 3 is introduced from an oxygen lance 4 through an oxygen lance tip 5, and a bottom-blowing gas is introduced into the melt through a nozzle 6 provided at the bottom of the converter. The bottom-blowing gas is one selected from the group consisting of an inert gas, nitrogen gas, oxygen gas, carbon monoxide gas, carbon dioxide gas and mixtures thereof. A slag-forming agent mainly comprised of quicklime in the form of powder is introduced into the melt together with an oxygen jet through said oxygen lance tip 5.

In a preferred embodiment of this invention, the desiliconized pig iron may also be subjected to dephosphorization prior to being charged into the converter. The slag-forming agent may comprise quicklime, fluorspar and iron ore.

Figure 2:
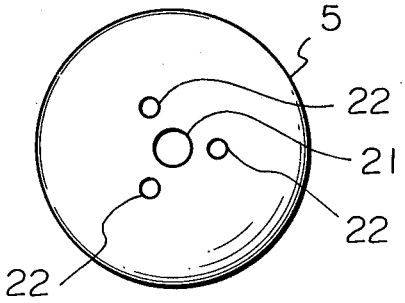
FIG. 2 is a schematic end view of the oxygen lance shown in FIG. 1.

As shown in FIG. 2, the slag-forming agent is supplied through the central nozzle 21, which is surrounded by three oxygen nozzles 22, through which oxygen jet are ejected toward the melt surface to introduce the slag-forming flux into the melt.

The structure of the oxygen lance tip 5 itself is already known in the art. As is apparent to the artisan, a variety of oxygen lance tips may be employed for the purpose of this invention.

This invention will be described in conjunction with working examples, which are presented merely for illustrative purposes, not for the purpose of limiting this invention in any way.

EXAMPLES

A 2.5 ton pure oxygen top-blowing converter having two bottom tuyeres with inner diameters of 8 mm was used to carry out the process of this invention. A molten pig iron in an amount of 2 tons was charged into the converter at 1380° C. Through the bottom tuyeres carbon dioxide gas was blown into the melt at a rate of 0.5 $Nm^3$/min. The supply of oxygen through the top oxygen lance was 6 $Nm^3$/min. The distance between the oxygen lance and the molten metal surface was 300 mm.

The desiliconization was carried out by blowing oxygen at a rate of 1.0 $Nm^3$/t of pig iron with the addition of quicklime of 8 kg/t and iron ore of 15 kg/t for 20 minutes.

Test results are summarized in the following table. For comparative purposes, the data obtained in accordance with the conventional processes are also shown therein.

As is apparent from the results shown in the Table below, according to this invention, a refined steel containing phosphorus in an amount of 0.004% or less can be obtained without any substantial loss of yield. The $CaO/SiO_2$ ratio of slag is higher than 4.0 in accordance with this invention. Test No. 7 shows the case wherein dephosphorization as well as desiliconization were applied prior to being charged into the converter. Phosphorus was removed to an extremely low level, i.e., to the level of 0.002% without any reduction in yield, though it took relatively long to achieve the refining. However, according to the conventional process, yield is not so high as in this invention, and the requisite amount of quicklime is relatively large. In addition, the phosphorus content is reduced only to a level of 0.005% at the most even when the pig iron dephosphorization process is employed, which requires a relatively large amount of quicklime and a relatively long period of treating time to effect the dephosphorization. The $CaO/SiO_2$ ratio is lower than 4.0.

TABLE

| No. | Process | Molten Pig Iron Before Charging (% by weight) Si | P | Slag-Forming Agent* Used until Refining Completed (kg/t of Steel) A*** | B*** | C*** | D*** | CaO/SiO2 Ratio of Slag | Composition of Steel After Refining (% by weight) C | Mn | P | S | Tapping Temp. (°C.) | Total Process Time (min) | Total Yield (%) |
|---|---|---|---|---|---|---|---|---|---|---|---|---|---|---|---|
| 1 | Double Slag process | 0.51 | 0.122 | 110 | 24 | 0 | 10 | 3.0–3.8 | 0.05 | 0.07 | 0.007 | 0.005 | 1635 | 62.4 | −1.1 |
| 2 | Pig Iron Dephosphorization + Oxygen | 0.01 | 0.010 | 65 | 20 | 80 | 5 | 3.0 | 0.03 | 0.06 | 0.005 | 0.004 | 1640 | 65.0 | −1.1 |
| 3 | Dephosphorization After Steel Refining | 0.50 | 0.119 | 74 | 13 | 8 | Electric Power 60 KWH/t | 3.8 | 0.02 | 0.04 | 0.006 | 0.004 | 1635 | 51.0 | −0.9 |
| 4 | TB Process Without Pretreatment | 0.5 | 0.125 | 40 | 5 | 0 | 0 | 3.8 | 0.38 | 0.30 | 0.012 | 0.019 | 1680 | 19.3 | 0 |
| 5 | Desiliconization + TB Process | 0.17 | 0.118 | 51 | 10 | 15 | 0 | 12.0 | 0.48 | 0.08 | 0.004 | 0.002 | 1630 | 36.8 | 0 |
| 6 | Desiliconization + TB Process | 0.01 | 0.108 | 40 | 5 | 20 | 0 | 28.0 | 0.42 | 0.10 | 0.003 | 0.003 | 1625 | 39.7 | +0.1 |
| 7 | Pig Iron Dephosphorization + TB Process** | 0.01 | 0.008 | 65 | 15 | 8 | 9 | 27.0 | 0.44 | 0.05 | 0.002 | 0.001 | 1635 | 64.8 | +0.1 |

Figure 3:
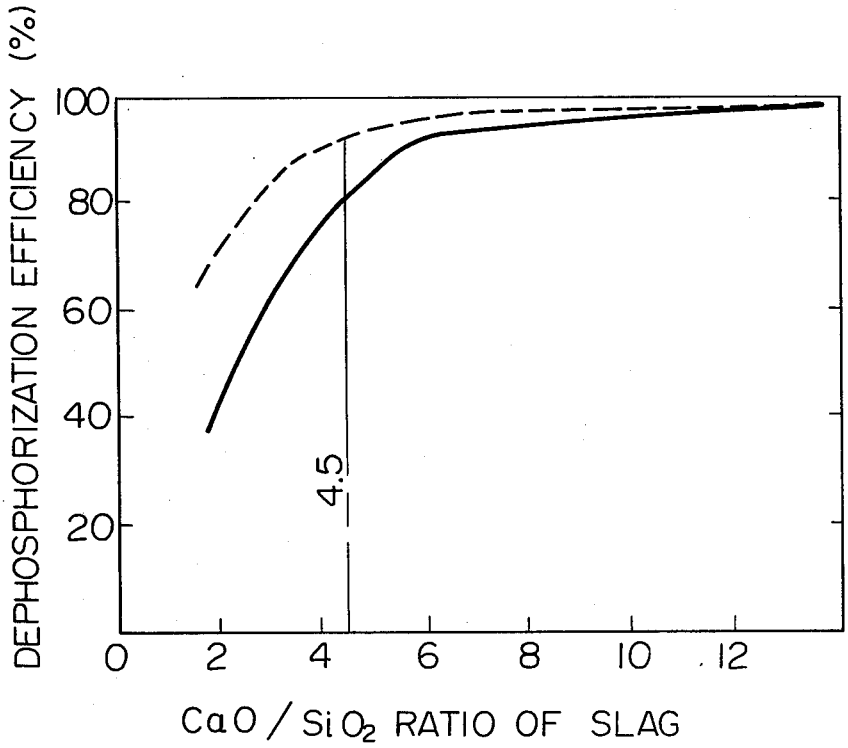
FIG. 3 is a graph showing the relationship between the dephosphorization (%) and the $CaO/SiO_2$ ratio of slag.

NOTE:
*Total amount
**Desiliconization also occurred.
***A: Quicklime, B: Fluorspar, C: Iron Ore, D: Fe—Si
REMARKS: Nos. 5, 6 and 7 — This Invention FIG. 3 shows the relationship between the dephosphorization (%) and the $CaO/SiO_2$ ratio of slag, which was obtained from a series of experiments which were carried out in accordance with this invention. The solid line shows the case in which the amount of slag was 40 kg/t of steel, and the dotted line shows the case in which the amount of slag was 80 kg/t of steel. As is apparent from the graphs shown therein, it is possible to attain a $CaO/SiO_2$ ratio of higher than 4.5, and even higher than 10 in accordance with this invention. It is thought that the attainment of such a high $CaO/SiO_2$ ratio is one of the reasons why an ultra-low phosphorus steel can be produced in accordance with this invention.

Although the invention has been described with preferred embodiments it is to be understood that variations and modifications may be employed without departing from the concept of this invention as defined in the following claims.

What is claimed is:

1. A process for producing an ultra-low phosphorus steel containing 0.010% or less of phosphorus, which comprises charging a desiliconized pig iron into a top- and bottom-blowing oxygen converter, introducing a slag-forming agent in a powdered form onto the molten iron together with the top-blowing oxygen and introducing a bottom-blowing gas selected from the group consisting of an inert gas, nitrogen gas, oxygen gas, carbon monoxide gas, carbon dioxide gas and mixtures thereof during the oxygen top-blowing or during both the oxygen top-blowing and the subsequent tapping.

2. A process as defined in claim 1, in which the silicon content of the desiliconized pig iron is 0.20% or less.

3. A process as defined in claim 1, in which the desiliconized pig iron is also subjected to dephosphorization and the thus desiliconized pig iron contains 0.030% or less of phosphorus and 0.05% or less of silicon.

4. A process as defined in claim 1, in which said slag-forming agent is comprised of one or more selected from the group consisting of quicklime, limestone, fluorspar, dolomite, iron ore and mixtures thereof.

5. A process as defined in claim 4, in which said slag-forming agent is comprised of quicklime, fluorspar and iron ore.

6. A process for producing an ultra-low phosphorus steel containing 0.003% or less of phosphorus, which comprises preparing a desiliconized pig iron in a top- and bottom-blowing oxygen converter, introducing a slag-forming agent in a powdered form onto the molten iron together with the top-blowing oxygen and introducing a bottom-blowing gas selected from the group consisting of an inert gas, nitrogen gas, oxygen gas, carbon monoxide gas, carbon dioxide gas and mixtures thereof during the oxygen top-blowing or during both the oxygen top-blowing and the subsequent tapping.

7. A process as defined in claim 6, in which the silicon content of the desiliconized pig iron is 0.20% or less.

8. A process as defined in claim 6, in which the desiliconized pig iron is also subjected to dephosphorization and the thus desiliconized pig iron contains 0.030% or less of phosphorus and 0.05% or less of silicon.

9. A process as defined in claim 6, in which said slag-forming agent is comprised of one or more selected from the group consisting of quicklime, limestone, fluorspar, dolomite, iron ore and mixtures thereof.

10. A process as defined in claim 9, in which said slag-forming agent is comprised of quicklime, fluorspar and iron ore.

* * * * *